US006520591B1

(12) United States Patent
Jun et al.

(10) Patent No.: US 6,520,591 B1
(45) Date of Patent: Feb. 18, 2003

(54) R.B. JUN'S METHOD OF OPENWORK MINING UTILIZING PIT WALL CONSOLIDATION

(76) Inventors: Ruslan Borisovich Jun, 477004 Zhezkazgan, ul. Dzerzhinskogo dom 11, kv. 1, Zhezkazgan (KZ); Vitaly Ivanovich Borsch-Komponiets, 12311 Moscow, ul. 1905 year, dom. 3, kv. 79, Moscow (RU)

( * ) Notice: Subject to any disclaimer, the term of this patent is extended or adjusted under 35 U.S.C. 154(b) by 0 days.

(21) Appl. No.: 09/674,997

(22) PCT Filed: Aug. 27, 1998

(86) PCT No.: PCT/RU98/00277

§ 371 (c)(1),
(2), (4) Date: Feb. 8, 2001

(87) PCT Pub. No.: WO99/58817

PCT Pub. Date: Nov. 18, 1999

(30) Foreign Application Priority Data

May 12, 1998 (RU) ..... 98108342

(51) Int. Cl.[7] ..... E21C 41/26; E02D 3/00; E02D 3/12

(52) U.S. Cl. ..... 299/19; 299/12; 299/15; 405/302.4

(58) Field of Search ..... 299/11, 12, 15, 299/18, 19; 172/1; 37/195; 405/259.5, 258.1, 302.4, 259.1

(56) References Cited

U.S. PATENT DOCUMENTS 3,893,303 A * 7/1975 Rotter
4,058,079 A * 11/1977 Taylor et al.
4,790,129 A * 12/1988 Hutchins
5,087,160 A * 2/1992 Pezzutto
5,216,922 A * 6/1993 Gustafson et al.
5,931,875 A * 8/1999 Kemner et al.

FOREIGN PATENT DOCUMENTS

| | | | |
|---|---|---|---|
| RU | 595507 | * | 2/1978 |
| RU | 812922 | * | 9/1978 |
| RU | 80360 | * | 9/1979 |
| RU | 1254155 | * | 4/1985 |
| RU | 1425329 | * | 9/1988 |
| RU | 1789700 | * | 4/1990 |

* cited by examiner

*Primary Examiner*—David Bagnell
*Assistant Examiner*—David P Stephenson
(74) *Attorney, Agent, or Firm*—McDermott, Will & Emery

(57) ABSTRACT

The invention relates to the mining industry and can be used for working out mineral deposits, no matter what their thickness and dip angle are, and allows to reduce the volumes of overburden operations. The invention provides the working out the main reserves by openworks, with forming safety benches (22) on steps of an open cut. From the top view, reserves of each level (1) are being worked out by blasting descending holes in direction to working flank of an open cut with forming safety prisms near a designed contour thereof. The breaking out of safety prisms (5) is being carried out at the final stage of works on the level (1) with forming a vertical or close to vertical, slope within the level. Rocks of near-contour mass (6) in a zone of probable displacement of rocks being reinforced by injecting and/or installing prestressed anchors (8).

16 Claims, 4 Drawing Sheets

R.B. JUN'S METHOD OF OPENWORK MINING UTILIZING PIT WALL CONSOLIDATION

FIELD OF ART

The invention relates to the mining industry and can be used for working out mineral deposits not depending of their thickness and bedding angle.

PRIOR ART

In the prior art there is a known method for mining of deposits which includes the carrying out of mining works by an openwork method with the use of self-propelled machinery, over-passing rock bulk into underground mine workings worked out earlier and subsequent hoisting thereof over a conveyer slope to the surface (U.S. Pat. No. 4,103, 972; US C1. 299/18, 1978).

There is also a known method of the openwork of deposits which provides the breaking of main reserves by blasting holes from the surface of steps and the transporting of the rock bulk to the surface. The descending blast holes for breaking the ore are drilled from the open cut's bottom (V. N. Synchkovsky, "Tekhnologia otkrytykh gornykh rabot" [The technology of mine openworks], Krasnoyarsk, Krasnoyarsk State University, 1989, p.p. 356–358).

Disadvantages of the known solutions are:

- the necessity of a preliminary construction of the whole complex of underground mining out works for transporting the broken rock bulk to the surface that involves substantial capital initial expenditures and postpones time limits of putting into operation thereof;
- the substantial volume of overburden operations due to the impossibility of forming an open cut with a steep final angle of a flank.

DISCLOSURE OF THE INVENTION

It is an object of the invention to provide a reduction in the volume of overburden operations owing to a steep angle of an open cut flank's run.

This is accomplished owing to that, in a method of the openwork of deposits which provides the breaking of main reserves by blasting descending holes from the surface of steps and the transporting of the rock bulk to the surface, the working our of levels' reserves being done with forming a vertical or close to vertical, slope of one of an open cut's flanks within a definite level, for that, near a contour thereof, a safety prism is being formed, the breaking of which is being done at the final stage of works on the level, and rocks beyond the open cut's contour and located within a zone of possible displacement of the open cut's flank are reinforced by prestressed anchors and/or by injecting binding grouts via holes, the main reserves of levels are being worked with self-propelled machinery being involved, remote control equipment being used for working out the safety prisms, the resources thereof are extracted by selective methods, the rocks, being beyond the open cut's contour and located within a zone of possible displacement of the open cut's flank, are being reinforced by separate portions located discretely or by a continuity on the whole surface of possible displacement of the open cut's flank, the rock being near the contour are being reinforced additionally by means of preliminary pumping of binding grouts and/or by installation of anchors, vertical or close to vertical, slopes of a steep flank are being formed, the injecting of rock is being carried out by pumping grout via holes drilled through the body of the safety prisms, into rocks being located beyond the open cut's contour, steel ropes arranged to be disposed on the earth surface and anchored beyond the displacement with the ends thereof monolithed at various depths, the safety prisms being drilled out by horizontal or ascending holes, in the body of the safety prisms there are mine working from which the drilling out of these prisms is being carried out as well as works for reinforcing rocks in the zone of possible displacement of the open cut's flank, the injecting of binding grouts is being carried out through vertical and curve holes drilled from the surface, and a safety bench of steep flank is being formed for several levels.

The order provided for carrying out the work allows to form, within a level, a vertical or close to vertical angle of a flank's run. This has become possible by virtue of that the safety prisms formed within the level being worked out along the entire flank prevent the occurrence of emergency situations caused by probable local cavings of rocks, when combined with the order provided for carrying out the work related to extraction of reserves of said safety prisms, and additional measures taken to improve the stability of the zone the mass of rocks around the contour to ensure the stability of that mass throughout the entire period of the operation of the mining enterprise.

The indicated object and advantages of the present invention will become apparent from the following description taken in conjunction with the accompanying drawings.

Figure 1:
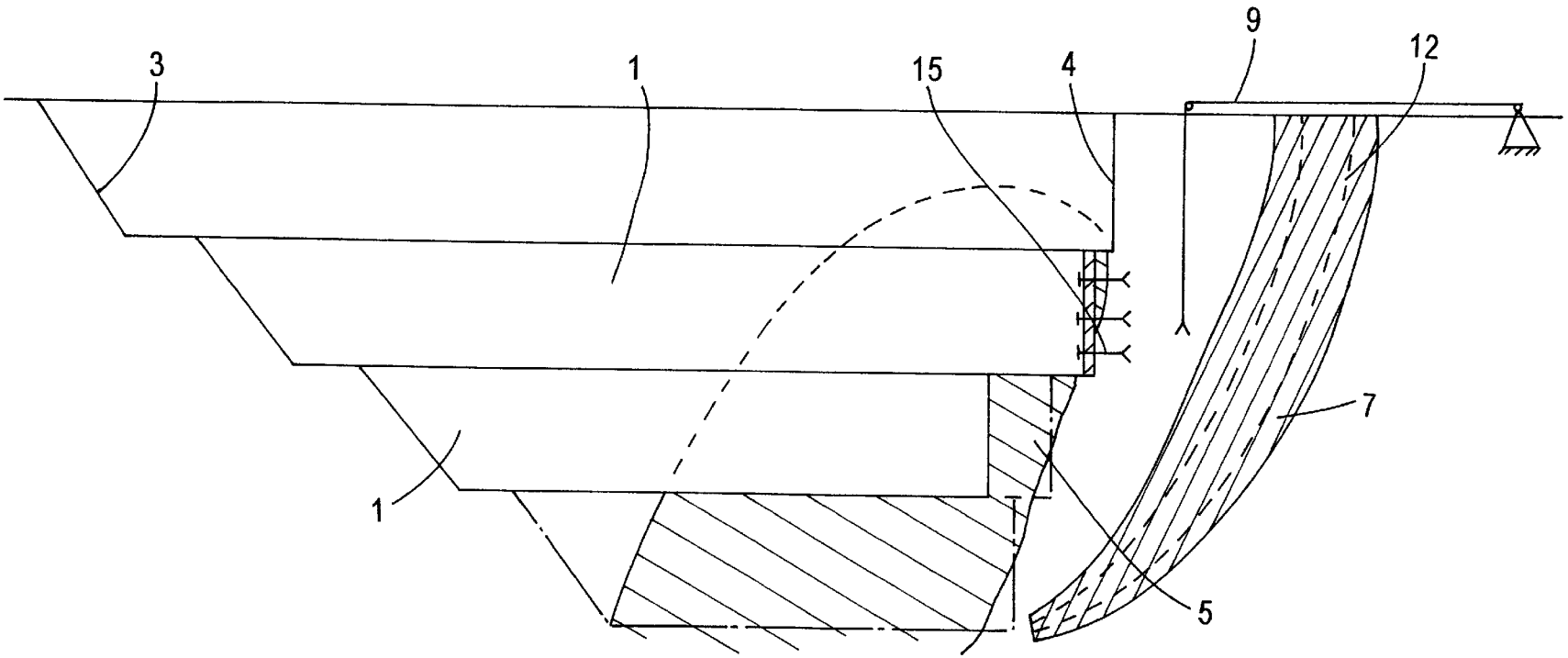
FIG. 1 is a diagram showing how the method of invention is to be realized under the conditions of working out a steeply dipping thick ore bed with safety benches being formed on each level.
Figure 2:
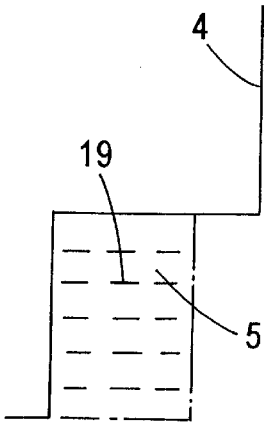
FIG. 2 is a diagram showing how to drill out safety prisms by horizontal holes.
Figure 3:
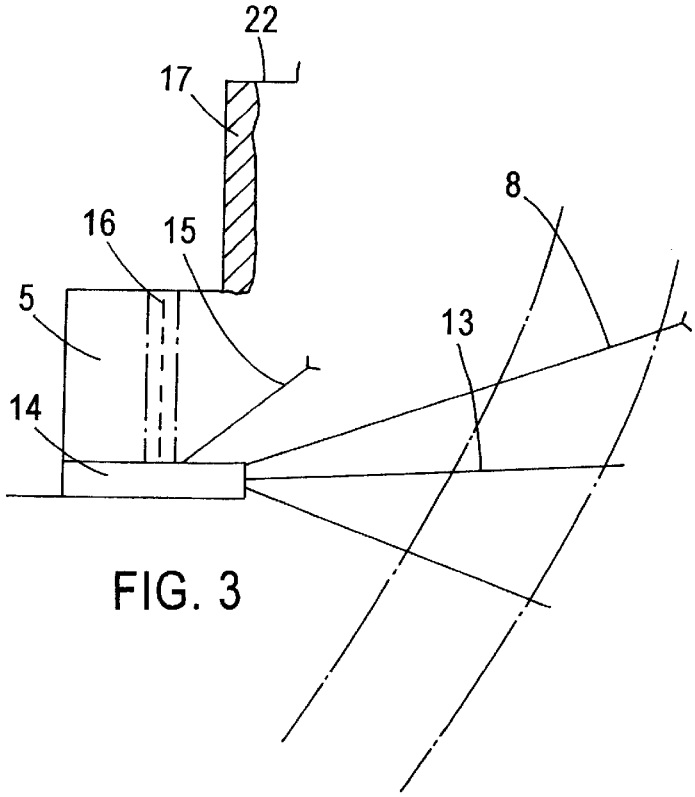
FIG. 3 is a diagram showing how to form a reinforced zone by injecting and installing prestressed anchors from a mine working.
Figure 4:
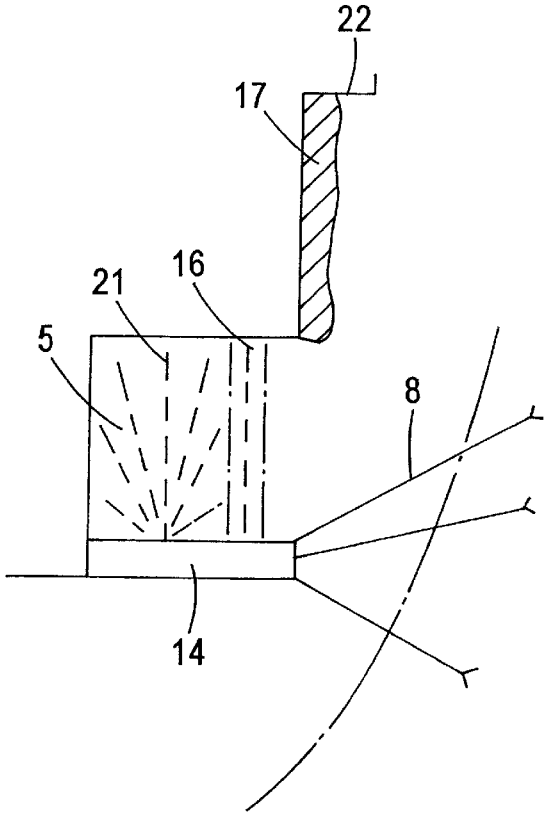
FIG. 4 is a diagram showing how to form a safety reinforced zone and to drill out a safety prism from a mine working.
Figure 5:
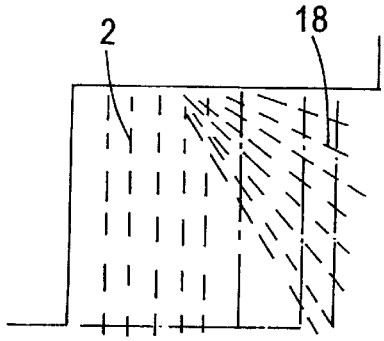
FIG. 5 is an embodiment for forming a safety reinforced zone from the surface of a step being worked out.
Figure 6:
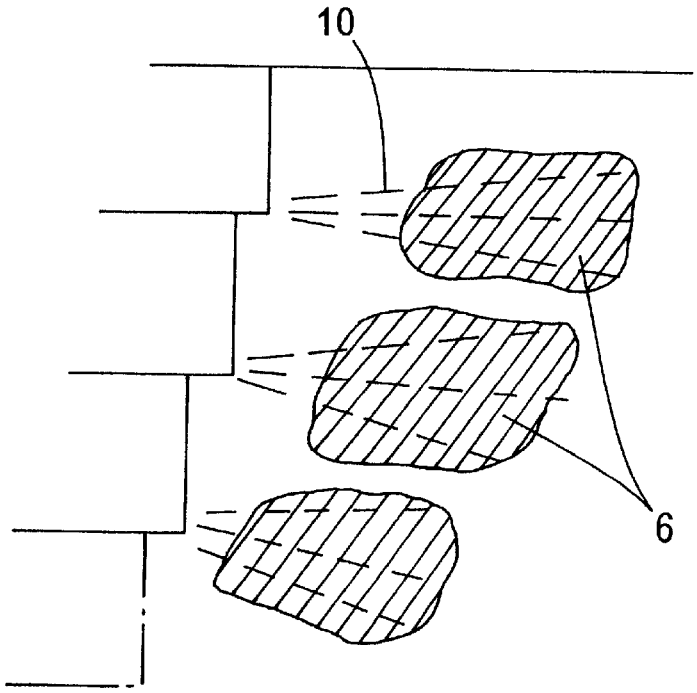
FIG. 6 is an embodiment for forming a reinforced zone in form of portions located discretely.
Figure 7:
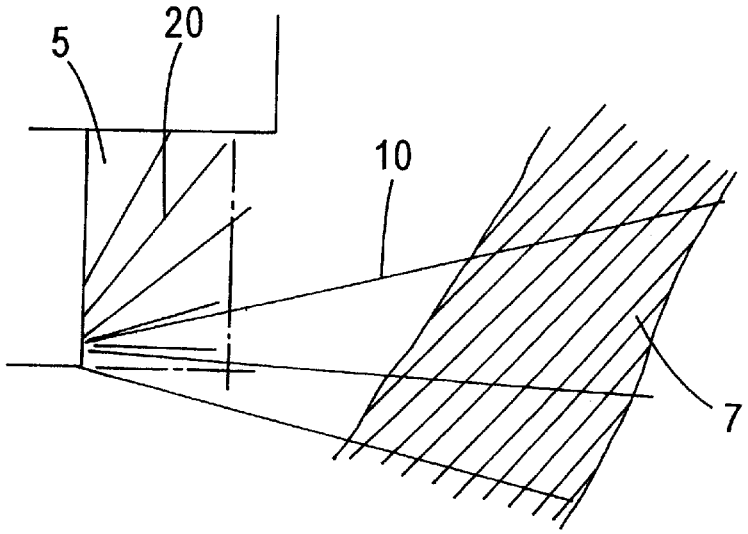
FIG. 7 is an embodiment for drilling out safety prisms from the bottom thereof.
Figure 8:
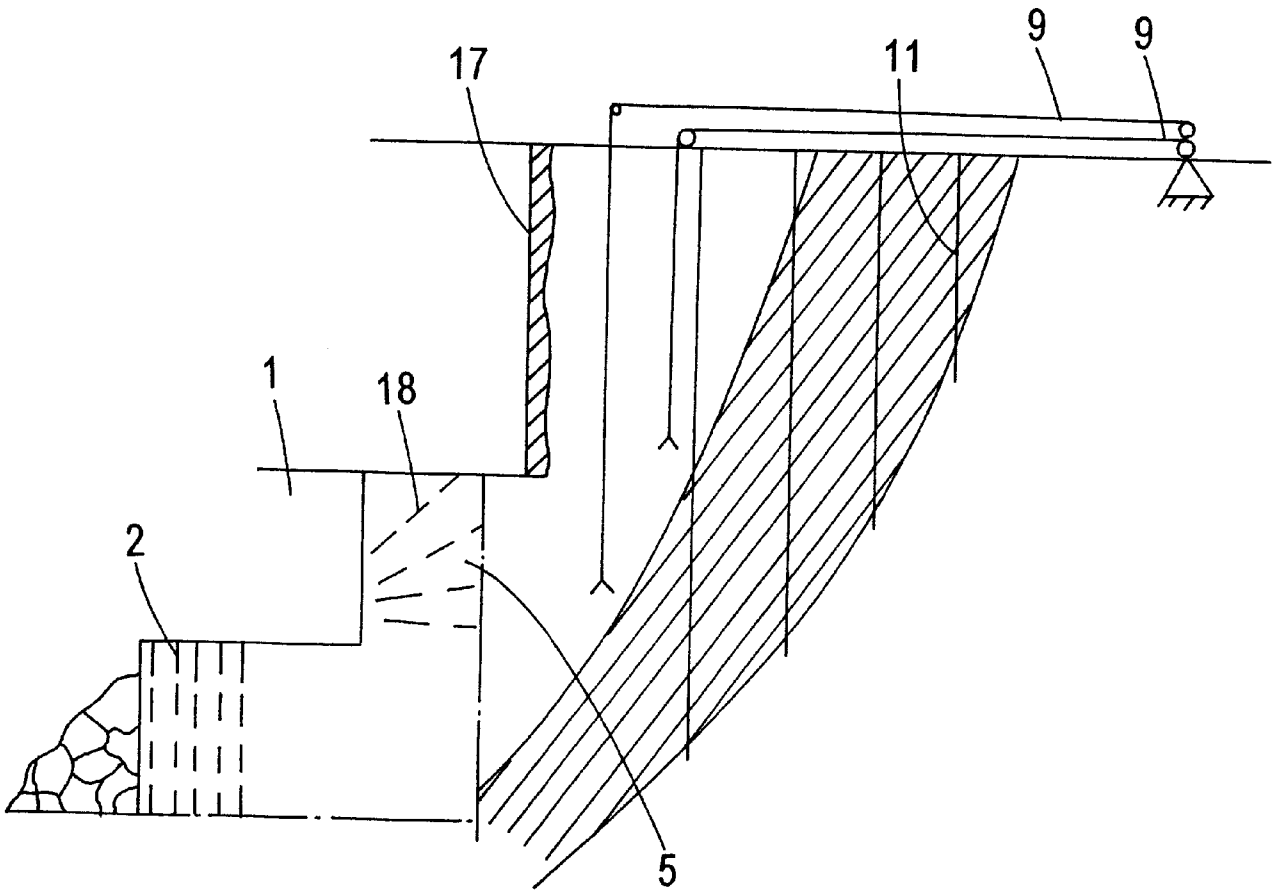
FIG. 8 is an embodiment for working out a deposit with forming safety benches for two levels and a reinforced zone via vertical holes from the surface.

The method is realized as follows.

The mining out of a deposit is being run by an open cut's steps defining the height of the level 1 and forming one gently sloping flank and other steep flanks.

The reserves are being drilled out from the surface of these steps by descending holes 2. The rock bulk broken by blasting holes is being transported to the surface along service lines located on the slope flank 3 of the open cut, for example by means of the self-propelled machinery. Within the level 1, the self-propelled machinery is also being used for technological operations.

From the top view, the working out of main reserves of the level 1 is being carried out in direction of the steep flank (vertical slope) 4 of the open cut leaving temporary safe prisms 5 on the perimeter thereof with a width being sufficient to provide safe condition of work for the entire period of workers' presence on this level. The width of these is defined, among other conditions, by preventing possible falls and exfoliations of rocks from a slope's flank 4 into the space of operations.

For holding the mass 6 of the flank 4 near to contour from a fall at a time of operations in the open cut, a reinforcing zone 7 is being formed in a zone of a supposed displacement by injecting binding grouts and resins into rocks as well as by installing prestressed anchors 8, locks of which are located beyond the supposed displacement zone defined by the surface's location of the probable displacement (slip).

Additionally, for holding the mass 6 (vertical slope) of the flank 4 near the contour from a fall, the ends of steel ropes 9 being laid on the earth surface can be monolithed at various depths. The other ends of the ropes 9 are being anchored beyond the displacement zone. Rails, pipes, etc. that have been already in use earlier, are to be placed under the ropes 9 prior to tensioning them up to prevent cutting the soil on the surface by the ropes 9 and this will allow to decrease the natural loosening of the ropes's stress in time.

Binding grout can be injected into rocks of a probable slip zone of rocks of the flank independently of the fact and the time of the installation of the anchors 8. In case of injection of grouts before installation of anchors 8, the grouts may include additionally admixtures retarding the hardening process. The amount and composition of these admixtures are to be selected on condition that polymerization of the compound thus injected should take place after the anchors 8 are tensioned up. In this case, the strength characteristics of the mass thus reinforced will be higher due to pressing excessive grout out of cracks and penetrating this grout deeper into the fissured mass of rocks.

Injection into the rocks to provide the reinforcing belt 7 can be carried out by means of horizontal or inclined holes 10 drilled through the body of the safety prisms 5 or to use, for this, vertical 11 or curve holes 12 drilled from the surface. Additionally, for increasing the load carrying capacity of the reinforcing belt 7, reinforcing rods may be placed into the holes 10 (on portions beyond the safe prisms 5), 11 and 12.

The injection into the rock for forming the reinforcing belt 7 can be carried out through the holes 13 from the specially run mine workings 14 in the body of safety prisms 5. In the workings 14, the anchors 8 may be installed as well as the anchors 15 preventing local slide-out of rocks of the mass 6 near the contour located between the reinforcing 7 and the surface of the flank 4.

The rocks beyond the contour of the open cut located within the zone of probable displacement of the flank 4 of the open cut (the reinforcing felt 7) are being reinforced by a continuity or by separate portions located discretely. The continuous reinforcing belt is being formed by one stage for the entire designed depth of the open cut through the holes 11 and/or the holes 12 drilled from the surface or by separate portions in process of the deeping of mine works.

Before working out the safety prisms 5, a sheaf of the holes 16 are being drilled from the working 14 directly beyond the designed contour of the flank 4, a safe reinforcing zone 17 is being formed by injection of binding grouts near the surface thereof preventing local slides-out of rocks caused by blast operations.

For forming the safe reinforcing zone 17, sheafs of holes 18, via the body of the safe prisms 5, drilled from the step may be also used. In this case, the injection of binding grouts into the holes 18 is being carried out on definite intervals of their length.

The amount, tension and supporting power of the prestressed anchors 8 and the ropes 9 are determined based on condition that stability of the open cut's flank 4 is ensured throughout the entire period while the mining enterprise is in service.

After the main reserves of level 1 are extracted, the remaining reserves of mineral in the safety prisms 5 are being worked out so as to form the final design contour of the deep flank 4 of the open cut. The mass of these prisms is preliminary drilled out by the horizontal holes 19 by means of track-mounted drills placed at the face or by sheafs of ascending holes 20 being drill from the foot thereof, or by sheafs of holes 21 from the workings 14. Drilling and blasting operations, when breaking the safety prisms 5, are carried out so as to form the final surface of the flank 4 of the level 1 being vertical or close to vertical within the above-mentioned level.

At the final stage of working out the reserves of the level 1, the bulk rock broken down from the safety prisms 5 is being removed by means of remote control equipment.

In case if the safety prisms 5 are disposed on an "ore"-to-"rock" interface, selective extraction is carried out.

In the process of working out the level 1, the open cut's flank 4 is formed with a safety bench 22 which has its width determined on condition that sufficiently reliable protection is ensured for the people and equipment on the underlying level 1 being worked out against falling stones and accumulating material of talus for as long as the work is being carried out. These benches are not designed to be used for transporting or other purposes, except for ones mentioned above, so that their minimum width and the maximum total steepness of the flank 4 are thus ensured.

In some cases, with enclosing rocks being rather stable, it is advisable to form one safety bench 22 for several levels 17.

In case of working out ore bodies with a gentle sloping angle, the gentle sloping flank 3 of the open cut with transport service lines placed thereon is being formed with a final angle equal an angle of incidence of a laying side of the ore body.

The Industrial Applicability

The realization of the methods of the invention allows to work out mineral deposits with more steep angles for forming of mine open cut.

The increasing of an angle of the forming of an open cut's flank gives the possibility to decrease the volume of overburden works on a flank of an open cut by 70–80% and thus to decrease costs for working out of a deposit and for recultivation of rock spoil banks.

The more steep of an open cut's flank decreases areas being withdrawn from the economy turnover for working out a deposit because there is no necessity to tear away a part of near areas, and additionally decreases areas for rock spoil banks by 80–90%.

What is claimed is:

1. A method of openwork mining of deposits providing the breaking-out of the main reserves by blasting descending holes from the surface of steps and transporting the rock mass to the surface, wherein the working out of reserves of levels being carried out with forming a vertical or close to vertical, slope of one from flanks of an open cut within said level, for that, a safety prism being formed near a contour thereof, breaking out said prism being carried out at the final stage of works on the level, and rocks beyond the open cut's contour located within a probable displacement zone of the open cut's flank are being reinforced by injecting binding grouts through holes.

2. The method according to claim 1, wherein main reserves of said level are being worked out with self-propelled machinery being involved, using remote control equipment for working out safety prisms, and resources thereof are extracted by selective methods.

3. The method according to claim 1, wherein rocks beyond the open cut's contour located within a zone of probable displacement of the open cut's flank are being reinforced by separate portions located discretely.

4. The method according to claim 1, wherein a zone of reinforced rocks beyond the open cut's contour is being formed by a continuity on the entire surface of possible displacement of the open cut's flank.

5. The method according to claim 1, wherein a near-contour mass of a slope of a vertical flank is being additionally reinforced by the way of preliminary injecting binding grout.

6. The method according to claim 5, wherein the near-contour mass is additionally reinforced by installing anchors.

7. The method according to claim 5, wherein the near-contour mass is additionally reinforced by the preliminary injecting said binding grout and by installing anchors.

8. The method according to claim 1, wherein slopes of a steep flank are being formed as vertical or close to vertical.

9. The method according to claim 1, wherein injecting into rock is being carried out by forcing grouts through holes drilled through the body of safety prisms.

10. The method according to claim 1, wherein ends of steel ropes are being additionally monolithed at various depths in rock beyond the open cut's contour, said ropes being located on the earth surface and being anchored beyond a displacement zone.

11. The method according to claim 1, wherein drilling out safety prisms is being carried out via horizontal or ascending holes.

12. The method according to claim 1, wherein mine workings are being run in the body of prisms on the levels, drilling out of said prisms is being carried out from said workings, as well as carrying out works for reinforcing rocks of a zone of probable displacement of the open cut's flank.

13. The method according to claim 1, wherein reinforcing rocks of a zone of probable displacement of the open cut's flank is being carried out by injecting binding grouts through vertical or curve holes drilled from the surface.

14. The method according to claim 1, wherein a safety bench of an operational flank is being formed for several levels.

15. The method according to claim 1, wherein said rocks are reinforced by installing prestressed anchors.

16. The method according to claim 1, wherein said rocks are reinforced by injecting said binding grouts through holes and by installing prestressed anchors.

* * * * *